US007726162B2

(12) United States Patent
Druesne et al.

(10) Patent No.: US 7,726,162 B2
(45) Date of Patent: Jun. 1, 2010

(54) METHOD OF SHAPING CONTAINER BODIES AND CORRESPONDING APPARATUS

(75) Inventors: Guy Druesne, La Fleche (FR); Cornelis Verboom, HP Leeuwarden (NL)

(73) Assignee: Impress Group B.V., Deventer (NL)

( * ) Notice: Subject to any disclaimer, the term of this patent is extended or adjusted under 35 U.S.C. 154(b) by 824 days.

(21) Appl. No.: 11/578,297

(22) PCT Filed: Apr. 13, 2005

(86) PCT No.: PCT/EP2005/005206

§ 371 (c)(1),
(2), (4) Date: Oct. 13, 2006

(87) PCT Pub. No.: WO2005/099926

PCT Pub. Date: Oct. 27, 2005

(65) Prior Publication Data

US 2007/0271993 A1 Nov. 29, 2007

(30) Foreign Application Priority Data

Apr. 16, 2004 (EP) ..... 04356053

(51) Int. Cl.
*B21D 22/26* (2006.01)
*B21D 26/02* (2006.01)

(52) U.S. Cl. ..... 72/58; 72/61; 72/62; 72/347; 72/370.22; 29/421.1

(58) Field of Classification Search ..... 72/57, 72/58, 60, 61, 62, 342.6, 342.94, 347, 348, 72/370.22, 709; 29/421.1
See application file for complete search history.

(56) References Cited

U.S. PATENT DOCUMENTS

| | | | | |
|---|---|---|---|---|
| 3,335,590 | A * | 8/1967 | Early | 72/58 |
| 5,187,962 | A * | 2/1993 | Bilko et al. | 72/370.22 |
| 5,214,948 | A * | 6/1993 | Sanders et al. | 72/58 |
| 5,746,080 | A * | 5/1998 | Hartman et al. | 72/342.94 |
| 5,829,290 | A * | 11/1998 | Harvey | 72/58 |
| 5,832,766 | A * | 11/1998 | Hartman et al. | 72/62 |

(Continued)

FOREIGN PATENT DOCUMENTS

| | | |
|---|---|---|
| DE | 197 51 413 | 6/1999 |
| EP | 0 521 637 | 1/1993 |
| EP | 0 853 513 | 8/2001 |
| WO | 98/17416 | 4/1998 |

*Primary Examiner*—David B Jones
(74) *Attorney, Agent, or Firm*—Young & Thompson

(57) ABSTRACT

Method wherein a) a container (1, 6) is placed in a two halves mould (2) having an internal shaped wall (21), b) an internal pressure P of a fluid is build up so as to shape the skirt (12), is characterized in that an external pressure P'of a fluid is applied in an upper space (101) contiguous to an external or upper surface (100) of the open top end (10) and/or in a lower space (141) contiguous to an external or lower surface (140) of the shaped bottom end (14), so as to have, during the span of time Δt, a pressure difference ΔP|P−P'1 low enough to prevent any distortion of the shaped open top end (10) and/or the shaped bottom end (14), so as to form a shaped metallic container (1', 6'). An apparatus for carring out the method is also disclosed.

35 Claims, 4 Drawing Sheets

U.S. PATENT DOCUMENTS 5,970,767 A * 10/1999 Hartman et al. ..... 72/62
6,009,734 A * 1/2000 Augustin et al. ..... 72/58
6,386,012 B2 * 5/2002 Minamidate et al. ..... 72/302
6,820,317 B2 * 11/2004 Okada ..... 29/421.1
7,296,449 B2 * 11/2007 Kubacki et al. ..... 29/421.1
7,484,393 B2 * 2/2009 Tomizawa ..... 72/57

* cited by examiner

METHOD OF SHAPING CONTAINER BODIES AND CORRESPONDING APPARATUS

FIELD OF THE INVENTION

The invention deals with the shaping of metallic container bodies, typically the shaping of the lateral wall of the body in order to get new shapes derived from the original container bodies which are typically cylindrically shaped.

Typically, such containers are of the aerosol type with a comparatively high ratio H/D, H and D being respectively the height of the body and its diameter or greater dimension in section, such a ratio being greater than 1.

PRIOR ART

U.S. Pat. No. 5,794,474 discloses a method and apparatus for reshaping a container body utilizing multiple fluids. In one embodiment, a nozzle is introduced into the interior of the container body to apply a concentrated force to the interior surface of the container body with a high velocity liquid stream of water.

GB 2 224 965 discloses methods and devices for reshaping hollow members. The apparatus comprises a mould made of two mould halves forming a chamber, upper and lower supports, a hydraulic clamp to seal the flange of the can, and a mandrel with openings to feed compressed air in the can.

FR 1 345 493 discloses a method and an apparatus to reshape container bodies. The apparatus comprises a shaped mould made of two mould halves and a compression chamber with a piston.

EP 0 853 513 discloses systems and methods for making decorative shaped metal cans.

The method comprises steps of using a mould and supplying a pressurised fluid into the mould, the can being placed in the mould with a precompression.

WO 98/17416 discloses reshaping containers by expanding the container against a mould using pressurised air.

EP 0 824 978 discloses a device for remodelling a hollow object. The device comprises a mould, sealing means for sealing the mouth opening of the hollow object against the wall of the mould cavity, and compression and depression means, the compression and decompression means being adapted to store the energy available during decompression.

EP 0 521 637 discloses an apparatus and a method for reshaping containers with a double seam. The apparatus comprises a mould, means for sealing the open end of the container, means for supplying a fluid under pressure to the interior of the container, and holding means to prevent deformation of the double seam during expansion of the container.

PROBLEM TO SOLVE

Metallic containers are manufactured with precisely shaped top ends and precisely shaped bottom ends, the top ends having openings, the containers being typically closed by seaming, and possibly retorted.

Most of the metallic containers have straight skirts. But, there is a need to provide the market with metallic shaped containers, i.e. containers having both shaped skirts and precisely shaped top ends (with openings) and precisely shaped bottom ends.

The problem to solve is to shape a skirt of a metallic container without changing the geometrical characteristics of its precisely shaped top end with an opening and of its precisely shaped bottom end, given that any change would be a default impairing totally said container.

DESCRIPTION OF THE INVENTION

A first object of the present invention is a method of reshaping a skirt of a hollow metallic container having a typically shaped open top end with an opening and/or a typically shaped bottom end.

In such a method:

a) said container is placed in a two halves mould having an internal shaped wall, b) an internal pressure P of a fluid, typically air, is build up during a span of time $\Delta t$ within said hollow container forming a cavity, so as to shape said skirt by expanding it against said shaped wall, said shaped wall having with an internal surface defining a lateral space typically kept at atmospheric pressure.

Such a method is characterized in that an external pressure P' of a fluid, typically air, is applied in a said upper space contiguous to an external or upper surface of said open top end and/or in a said lower space contiguous to an external or lower surface of said shaped bottom end, so as to have, during said span of time $\Delta t$, a pressure difference $\Delta P=|P-P'|$ low enough to prevent any distortion of said shaped open top end and/or said shaped bottom end, so as to form a shaped metallic container.

Such a method solves the set problem. The method can be used with any type of container, or any size of container.

DETAILED DESCRIPTION OF THE INVENTION

Figure 1:
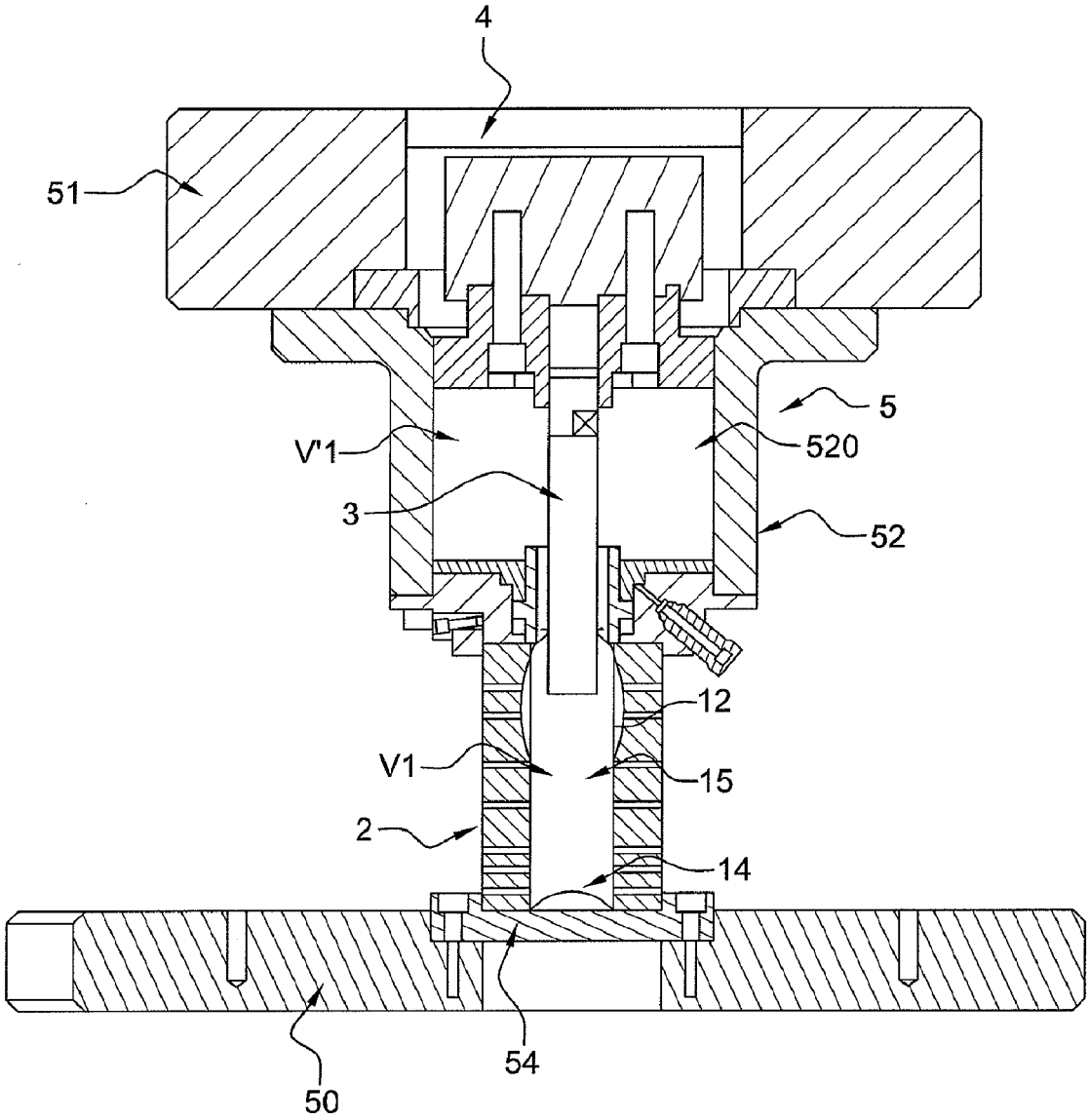
FIG. 1 is an axial section of the apparatus or the press used to reshape metallic containers, its upper and lower pistons being in upper position.

According to the invention, said pressure difference $\Delta P$ may be typically lower than 0.05 MPa for a thickness of 0.2 mm of a container made of aluminium, or for a thickness of 0.17 mm of a container made of steel. Said pressure difference may be generally lower than 0.01 MPa.

Upper and lower separating means may be used to prevent communication and pressure equalization between said lateral space (211), and said upper space (101) and/or lower space (141), so as to keep $\Delta P1$ and $\Delta P2$ as low as possible, $\Delta P1$ and $\Delta P2$ being the pressure differences between said cavity (15) and respectively said upper space (101) and said lower space (141), to prevent any distortion of said shaped open top end (10) and/or said shaped bottom end (14) during shaping of said skirt (12).

Said lateral space (211) being generally at the atmospheric pressure, and said lateral space (211), and said upper space (101) having to be kept at the comparatively high pressure P' close to internal pressure P, it is important to have means to separate lateral space (211) from upper space (101) and lower space (141).

Said upper space (101) and lower space (141) said may be kept at the same pressure typically with the help of duct or pipe connecting both spaces, so as to have $\Delta P1=\Delta P2$. The apparatus or press (5) of FIGS. 1 to 3 comprises such a duct or pipe connecting upper space (101) and lower space (141), but it has not been drawn on the figures.

According to an embodiment of the invention, compressed air with a same pressure P may be applied simultaneously in said cavity (15) of said hollow container (1, 6), said upper space (101) and said lower space (141).

According to another embodiment, said pressure build up P may be generated by operating a said lower piston (3) entering said cavity (15) of said hollow container (1) through said opening (11) so as to compress the air within said cavity (15) with a given compression ratio of V1/V2, V1 and V2 being respectively the internal volume of said cavity (15) before and after a move of said lower piston (3) of volume $V_L$ moving down into said cavity (15), with V2 typically equal to V1-$V_L$, said pressure P' being provided by an auxiliary pressure supplier.

In that case, said auxiliary pressure supplier may use compressed air with a device to equalize pressures P and P' during the span of time Δt. The span of time Δt is typically between 0.5 s and 2 s.

Figure 2:
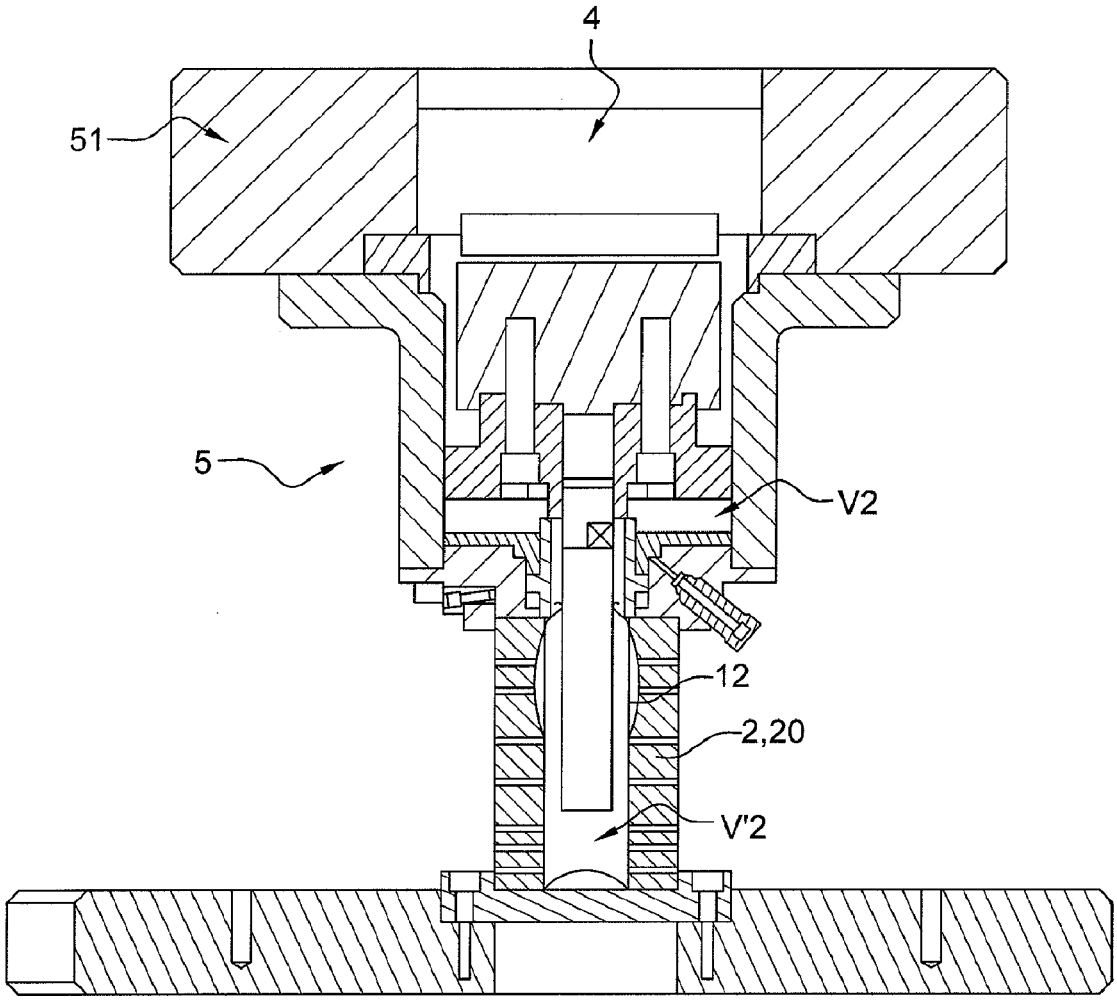
FIG. 2 is the same as FIG. 1, but with the upper and lower pistons being in lower position.
Figure 3:
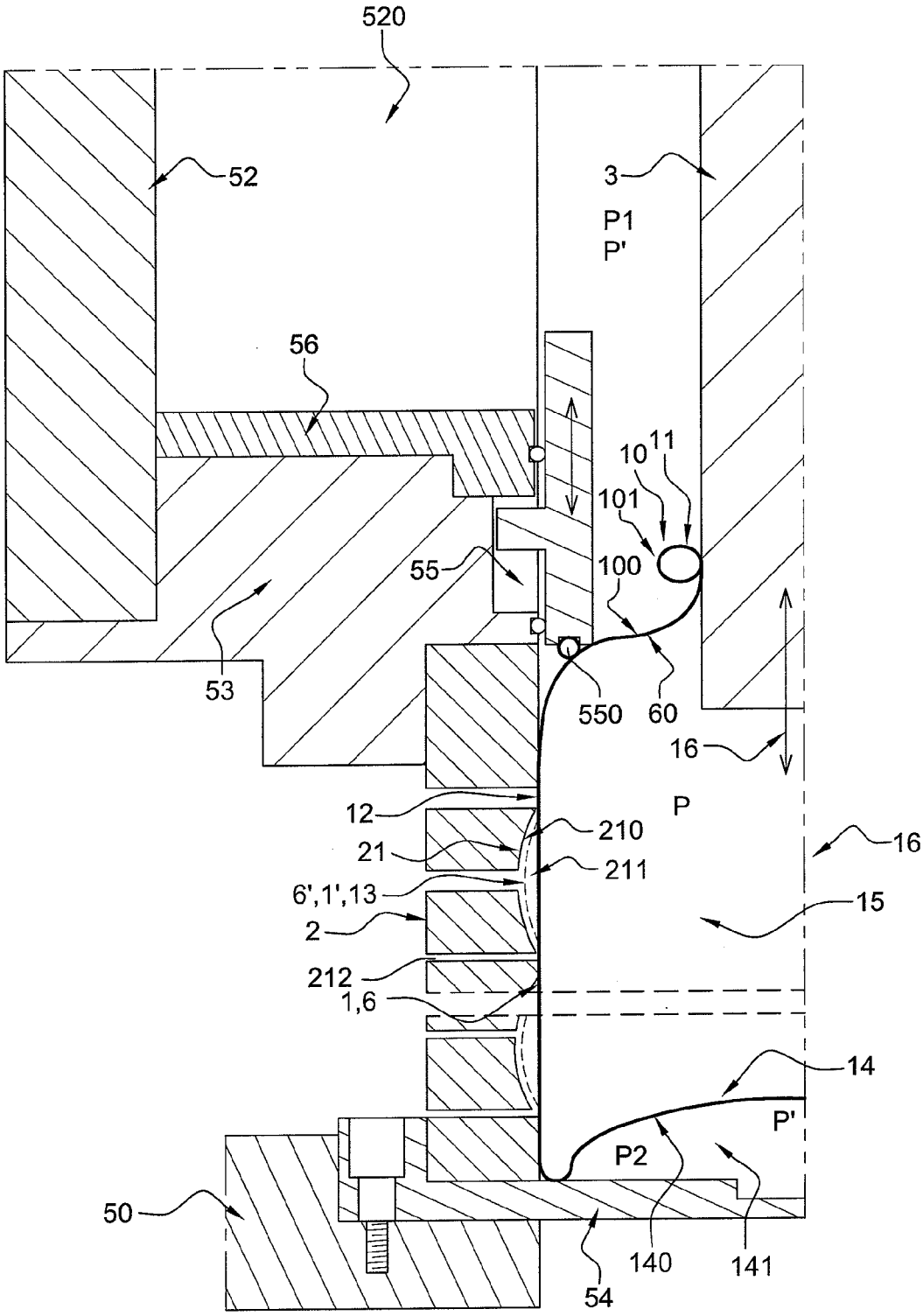
FIG. 3 is a partial detailed view of the apparatus according to FIG. 1.
Figure 4:
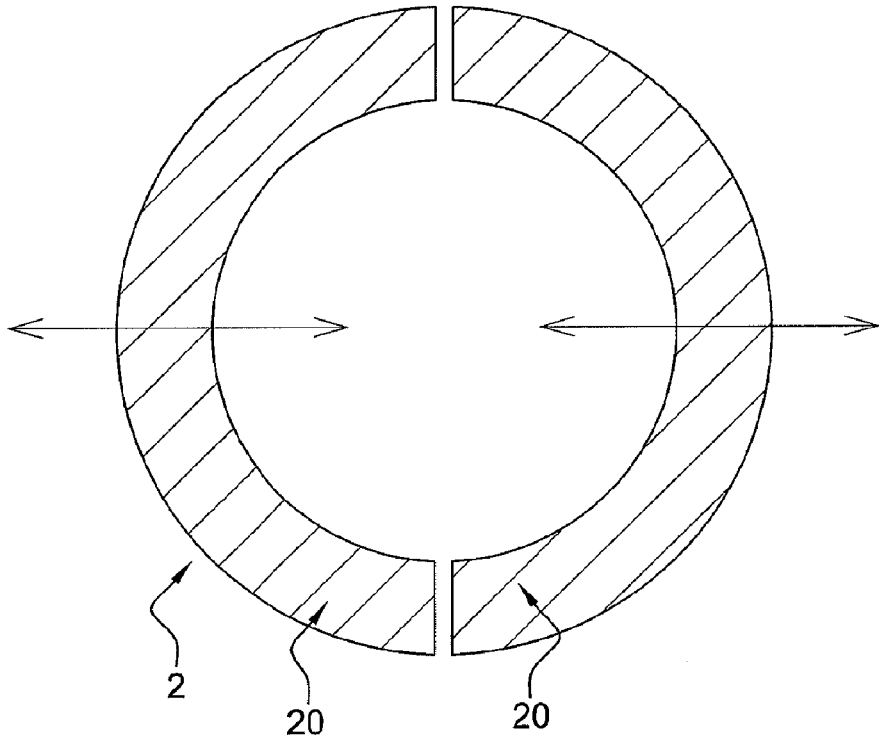
FIG. 4 is a transversal view of the shaping mould used in the apparatus or press of FIGS. 1 to 3.

But, as disclosed in FIGS. 1 to 3, said lower piston (3) may be operated with the help of an upper piston (4), said lower piston (3) being a lower part of said upper piston (4), said upper piston (4) moving in a upper compression body (52) of a press (5) forming a upper compression cavity (520) with a compression ratio of V'1/V'2, V'1 and V'2 being respectively the internal volume of said upper compression cavity (520) before and after a move of said upper piston (4) moving down into said upper compression cavity (520), said upper piston (4) moving inside said upper compression cavity (520), said upper space (101) being typically part of said upper compression cavity (520), so as to form said auxiliary pressure supplier.

Compression ratios V'1/V'2 and V1/V2 may be kept typically identical, with V'1×V2/V'2×V1 being comprised between 0.8 and 1.2 and preferably between 0.9 and 1.1, so as to have a pressure difference ΔP small enough to prevent any distortion of said shaped open top end and/or said shaped bottom end, so as to form a shaped metallic container.

Another object of the present invention is an apparatus, typically a press (5), for applying said method according to the invention for reshaping a skirt (12) of a hollow container (1) having typically a shaped open top end (10) with an opening (11), said apparatus comprising:

a) a two-halves mould (2) having an internally shaped wall (21), typically provided with lateral apertures (212) in order to keep its lateral space (211) at atmospheric pressure, said mould (2) and shaped wall (21) being designed to adapt to the size of said skirt (12) of said hollow container (1, 6), b) upper and lower means, typically an upper ring (53) and a lower base (54), to lock/unlock or to close/open said halves (20) of said mould (2), said upper and lower means preventing by themselves or possibly with additional means, any significant pressure equalizing between said lateral space and said upper and lower spaces, c) means for supplying a pressurized fluid in said cavity (15) of said hollow container (1, 6) to have an internal pressure P of a fluid, typically air, able to expand said skirt (12) against said shaped wall (21), d) auxiliary means for supplying a pressurized fluid, typically air, in said upper (101) and lower (141) spaces to have an external pressure P' of said fluid in said upper space (101) and lower space (141) to have a pressure difference ΔP=|P−P'| low enough to prevent any distortion of said shaped open top end (10) and/or said shaped bottom end (14), so as to form a shaped metallic container (1', 6').

Such an apparatus or press (5) may comprise means to equalize pressure between said upper space and said lower space, said means being typically a pipe or a duct connecting said upper space (101) and said lower space (141).

According to an embodiment of the apparatus, said means for supplying a pressurized fluid in said cavity (15) to have an internal pressure P of a fluid, typically air, may be said lower piston (3) able to move axially in said cavity (15) of said hollow container (1, 6) through said opening (11) so as to compress air inside said cavity (15) with a compression ratio V1/V2, V1 and V2 being respectively the internal volume of said cavity (15) of said hollow container (1, 6) before and after a move of said lower piston (3) moving down or entering into said cavity (15) of said hollow container (1, 6), pressure P' being provided by an auxiliary pressure supplier.

As illustrated in FIGS. 1 to 3, auxiliary means for supplying a pressurized fluid in said upper (101) and lower (141) spaces to have an external pressure P' of a fluid, typically air, may be said upper piston (4) moving in said upper compression cavity (520) so as to compress air with a compression ratio V'1/V'2, V'1 and V'2 being respectively the internal volume of said upper compression cavity (520) before and after a move of said upper piston (4) moving down into said upper compression cavity (520), said upper piston (4) moving inside said upper compression cavity (520) forming said auxiliary means or said auxiliary pressure supplier.

Said lower piston (3) may be a part of said upper piston (4), said lower piston (3) being operated by the move of said upper piston (4), both pistons (3) and (4) having the same axial displacement H during a compression cycle of said press (5).

Typically, said lower piston (3) may have a diameter close to the internal diameter of said opening (11), with a clearance between said lower piston (3) and said opening (11) allowing for a free move of said lower piston (3) through said opening (11).

According to the invention, values of V1, V2 and H being set, values of V'1 and V'2 are such that V'1×V2/V'2×V1 is comprised between 0.8 and 1.2 and preferably between 0.9 and 1.1, so as to have said pressure difference ΔP=|P−P'| low enough to prevent any distortion of said shaped open top end (10) and/or said shaped bottom end (14).

But it may possible, according to the invention, that said cavity (15) and said upper compression cavity (520) are kept at the same pressure P, said lower piston (3) cooperating with said opening (11) with a clearance high enough to allow for pressure equalization between said cavity (15) and said upper compression cavity (520) during said span of time Δt.

As pictured on FIG. 3, additional means may be a mobile ring (55) bearing typically a sealing ring (550).

Another object of the present invention is the use of method according to the invention, and/or the use of the apparatus according to the invention to manufacture shaped metallic containers, typically metallic cans, and metallic aerosols containers (6), starting from containers having already shaped top ends and/or shaped bottom ends.

EXAMPLE

The FIGS. 1 to 4 are an example of method and apparatus or press (5) according to the invention.

The metallic container (1) is an aerosol (6). It has a shaped open top end (10) and a shaped bottom end (14) as pictured in FIG. 3.

Lower (3) and upper (4) pistons move axially up and down typically in the axial direction (16) as pictured in FIG. 3.

Lower space (141) and upper space (101) are connected by a pipe not represented in FIGS. 1 to 3.

The press (5) pictured in FIGS. 1 to 3 comprise a complementary ring (56) for allowing axial displacement of mobile ring (55) bearing a sealing ring (550).

Such a press (5) is able to shape the skirt of a container having already a shaped top end and a shaped bottom end.

As can be seen, on FIG. 3, the container (1, 6) to be shaped is a standard aerosol ready to be filled and conditioned.

LIST OF REFERENCES

Metallic container . . . 1
Shaped metallic container . . . 1'
  Shaped top end of 1 . . . 10
    External or upper surface of 10 . . . 100
    Upper space . . . 101
  Opening of 1,10 . . . 11
  Skirt to shape . . . 12
  Shaped skirt . . . 13
  Shaped bottom end . . . 14
    External or lower surface of 14 . . . 140
    Lower space . . . 141
  Cavity of 1 . . . 15
  Axial direction . . . 16
Mould for shaping skirt 12 . . . 2
  Halves of 2 . . . 20
  Shaped wall of 2, 20 . . . 21
    Internal surface . . . 210
    Lateral space . . . 211
    Lateral apertures . . . 212
Lower piston . . . 3
Upper piston . . . 4
Apparatus-press . . . 5
  Base of 5 . . . 50
  Upper frame of 5 . . . 51
  Upper compression body . . . 52
    Upper compression cavity . . . 520
  Upper ring . . . 53
  Lower base . . . 54
  Mobile ring . . . 55
    Sealing ring . . . 550
  Complementary ring . . . 56
Aerosol metallic container . . . 6
  Shoulder of 6 . . . 60

The invention claimed is:

1. A method of reshaping a skirt (12) of a hollow metallic container (1, 6) to form a shaped metallic container (1', 6'), the hollow metallic container (1, 6) having a top end (10) with an opening (11), and a bottom end (14), the method comprising the steps of:

placing said container (1, 6) in a two halves mould (2) having an internal shaped wall (21);

building an internal pressure P of a first fluid during a span of time Δt within said hollow container to form a cavity (15) and to expand said skirt (12) against said shaped wall (21) such that said skirt is shaped by said shaped wall, said shaped wall (21) having an internal surface (210) defining a lateral space (211); and during said building step, applying an external pressure P' of a second fluid in any of i) an upper space (101) contiguous to an external surface (100) of said top end (10) and ii) a lower space (141) contiguous to an external surface (140) of said bottom end (14), so as to have, during said span of time Δt, a pressure difference ΔP =|P−'| wherein a distortion of a shape of said top end (10) and/or a shape of said bottom end (14) is prevented as said first pressurized fluid acts upon said skirt (12).

2. The method according to claim 1, wherein upper and lower separating means are used to prevent communication and pressure equalization between each of said lateral space (211) and any of said upper space (211) and said lower space (141) in order to minimize a pressure difference between said cavity (15) and any of said upper space (101) and said lower space (141).

3. The method according to claim 2, wherein compressed air is applied in each of said cavity (15), said upper space (101), and said lower space (141).

4. The method according to claim 2, wherein said internal pressure P is generated by operating a lower piston (3) to enter said cavity (15) through said opening (11) so as to compress the first fluid within said cavity (15), and said pressure P' being provided be an auxiliary pressure supplier.

5. The method according to claim 2, wherein said upper space (101) and said lower space (141) are kept at a same pressure so as to have a same pressure difference i) between said cavity (15) and said upper space (101) and ii) between said cavity (15) and said lower space (141) during said span of time Δt.

6. The method according to claim 5, wherein the a pipe connects said upper space (101) and said lower space (141) to maintain the same pressure.

7. The method according to claim 1, wherein a compressed fluid is applied in each of said cavity (15), said upper space (101), and said lower space (141) at a same pressure P.

8. The method according to claim 1, wherein said internal pressure P is generated by operating a lower piston (3) to enter said cavity (15) through said opening (11) so as to compress the first fluid within said cavity (15), and said external pressure P' being provided be an auxiliary pressure supplier.

9. The method according to claim 8, wherein said auxiliary pressure supplier uses compressed air, and includes a device configured to equalize pressures P and P' during said span of time Δt.

10. The method according to claim 8, wherein said lower piston (3) is a lower part of an upper piston (4), said upper piston (4) configured to move inside an upper compression body (52) of a press (5) with an upper compression cavity (520), so as to form said auxiliary pressure supplier providing said external pressure P'.

11. The method according to claim 10, wherein said upper space (101) is part of said upper compression cavity (520).

12. The method according to claim 10, wherein a first compression ratio of a first internal volume (V1) of said cavity (15) absent said lower piston and a second internal volume (V2) of said cavity (15) with said lower piston extended into said cavity (15), and a second compression ratio of a first internal volume (V'1) of said upper compression cavity absent said upper piston and a second internal volume (V'2) of said upper compression cavity with said upper piston extended into the upper compression cavity are such that $0.8<(V'1\times V2)/(V'2\times V1)<1.2$.

13. The method according to claim 12, wherein said first compression ratio and said second compression ratio are such that $0.9<(V'1\times V2)/(V'2\times V1)<1.1$.

14. The method according to claim 1, wherein the first fluid is air.

15. The method according to claim 1, wherein the lateral space (211) is maintained at atmospheric pressure.

16. The method according to claim 1, wherein the second fluid is air.

17. The method according to claim 1, wherein the hollow metallic container is aluminum with a thickness of 0.2 mm, and said pressure difference ΔP is less than 0.05 MPa.

18. The method according to claim 1, wherein the hollow metallic container is steel with a thickness of 0.17 mm, and said pressure difference ΔP is less than 0.05 Mpa.

19. An apparatus, for reshaping a skirt (12) of a hollow container (1) having a bottom end (14) and a top end (10) with an opening (11), comprising:

a mould (2) comprised of two halves, the two halves forming a lateral space (211) bounded by an internal shaped wall (21), said mould (2) and shaped wall (21) being configured to the size of said skirt (12) of said hollow container (1, 6);

means for supplying a first fluid in a cavity (15) inside said hollow container (1, 6) with an internal pressure P such that the first fluid causes said skirt (12) to expand against said shaped wall (21);

auxiliary means for supplying a second fluid in an upper space (101) contiguous to an external surface (100) of said top end (10) and a lower space (141) contiguous to an external surface (140) of said bottom end (14), said auxiliary means configured to supply the second fluid at an external pressure P' such that a pressure difference $\Delta P=|P-'|$ prevents a distortion of a shape of said top end (10) and a shape of said bottom end (14), when said first pressurized fluid acts upon said skirt (12); and upper and lower means configured to prevent a pressure equalizing between said lateral space (211) and said upper and lower spaces (101, 141).

20. The apparatus according to claim 19, further comprising:

means to equalize pressure between said upper space and said lower space.

21. The apparatus according to claim 20, wherein said means for supplying the first fluid comprises a lower piston (3) configured to move axially in said cavity (15) through said opening (11) to compress the first fluid inside said cavity (15).

22. The apparatus according to claim 20, wherein said means to equalize pressure between said upper space and said lower space is a duct connecting said upper space (101) and said lower space (141).

23. The apparatus according to claim 19, wherein said means for supplying the first fluid in said cavity (15) comprises a lower piston (3) configured to move axially in said cavity (15) through said opening (11) to compress the first fluid inside said cavity (15).

24. The apparatus according to claim 19, wherein auxiliary means for supplying a second fluid comprises an upper piston (4) configured to move in an upper compression cavity (520) above said mould (2), the upper piston (4) to compress the second fluid.

25. The apparatus according to claim 24, wherein said lower piston (3) has a diameter such that a clearance between said lower piston (3) and said opening (11) enables free movement of said lower piston (3) through said opening (11).

26. The apparatus according to claim 24, wherein said lower piston (3) cooperates with said opening (11) with a clearance high enough to allow for a pressure equalization between said cavity (15) and said upper compression cavity (520).

27. The apparatus according to claim 24, wherein said lower piston (3) is connected to said upper piston (4), said lower piston (3) configured to move with said upper piston (4), both of said upper and lower pistons (3, 4) configured to move with a same axial displacement H during a compression cycle.

28. The apparatus according to claim 27 wherein, a first compression ratio of a first internal volume (V1) of said cavity (15) absent said lower piston and a second internal volume (V2) of said cavity (15) with said lower piston extended into said cavity (15), and a second compression ratio of a first internal volume (V'1) of said upper compression cavity absent said upper piston and a second internal volume (V'2) of said upper compression cavity with said upper piston extended into the upper compression cavity are such that $0.8<(V'1\times V2)/(V'2\times V1)<1.2$.

29. The apparatus according to claim 28, wherein said first compression ratio and said second compression ratio are such that $0.9<(V'1\times V2)/(V'2\times V1)<1.1$.

30. The apparatus according to claim 19, wherein said upper and lower means includes a mobile ring (55) bearing.

31. The apparatus according to claim 30, wherein the mobile ring (55) is a sealing ring (550).

32. The apparatus according to claim 19, wherein the shaped wall (21) includes lateral apertures (212) configured to maintain the lateral space (211) at atmospheric pressure.

33. The apparatus according to claim 19, wherein the upper and lower means are an upper ring (53) and a lower base (54).

34. The apparatus according to claim 19, wherein the first pressurized fluid is air.

35. The apparatus according to claim 19, wherein the second pressurized fluid is air.

* * * * *